United States Patent [19]

Menard

[11] Patent Number: 4,796,493

[45] Date of Patent: Jan. 10, 1989

[54] APPARATUS AND METHOD FOR UNSCREWING A BICYCLE CHAIN SPROCKET

[76] Inventor: Richard J. Menard, 1680 Adanac Street, Vancouver, British Columbia, Canada, V5L 2S5

[21] Appl. No.: 15,687

[22] Filed: Feb. 17, 1987

Related U.S. Application Data

[63] Continuation-in-part of Ser. No. 853,857, Apr. 21, 1986, abandoned.

[51] Int. Cl.[4] ..... B25B 13/52

[52] U.S. Cl. ..... 81/65.2; 81/70; 29/240

[58] Field of Search ..... 81/65.2, 68, 69, 70, 81/64, 128, 8 D, 303, 304, 305, 306, 307, 308, 309, 310, 311, 312; 29/281.6, 240, 559

[56] References Cited

U.S. PATENT DOCUMENTS 412,096 10/1889 Kane ..... 81/65.2

4,373,240 2/1983 Castoe ..... 29/559

*Primary Examiner*—Frederick R. Schmidt

*Assistant Examiner*—Maurina Rachuba

*Attorney, Agent, or Firm*—Bull, Housser & Tupper

[57] ABSTRACT

A tool for unscrewing a bicycle chain sprocket from a bicycle sprocket cluster which can be used for roadside emergency repairs is disclosed. The tool has a hook which engages a portion of the bicycle frame, and a length of engagement chain which engages teeth of a sprocket to be removed. Preferably the hook engages the chain stay of the bicycle frame, and torque is applied to the sprocket cluster by the conventional driving chain. To improve mechanical advantage, the driving chain passes around the largest sprocket of the sprocket cluster, and the smallest sprocket of the chain wheel, and force is applied to the pedals at a mid-sweep position.

20 Claims, 3 Drawing Sheets

APPARATUS AND METHOD FOR UNSCREWING A BICYCLE CHAIN SPROCKET

CROSS REFERENCES TO RELATED APPLICATIONS

This is a continuation-in-part of my co-pending application Ser. No. 06/853,857, filed Apr. 21, 1986, now abandoned.

BACKGROUND OF THE INVENTION

The invention relates to a method and apparatus for removing a bicycle chain sprocket from a bicycle sprocket cluster, as found in conventional multi-speed pedal bicycles utilizing derailleur gear changers.

In modern, multi-speed pedal bicycles, a main drive chain is shifted by a derailleur gear shifter to engage and disengage bicycle chain sprockets of a sprocket cluster usually having at least five sprockets spaced laterally apart. The sprockets are mounted on a freewheel body, the body having a fixed inner portion secured to the wheel hub, and a freewheeling outer portion to which the sprockets are secured. Commonly, the larger or inner sprockets are splined or otherwise non-rotatably mounted on the outer portion, and the smaller one, two, and/or three outermost sprockets are threaded onto the outer portion with right hand threads, which also prevent the inner sprockets from coming from the body. During normal operation of the bicycle, the smaller outermost sprocket is tightened on its threaded connection to the outer portion, making removal difficult. To remove the threaded outermost sprocket, the sprocket must be rotated anti-clockwise relative to the outer portion of the freewheel body. Normally the sprocket itself can be rotated by a "chain whip" which is a lever arm and a short length of chain adapted to engage teeth of the sprocket. In order to prevent the outer portion of the freewheel body rotating freely due to the freewheel rachet mechanism, a freewheel vice or a second chain whip is used to engage the outer portion and prevent this rotation. Chain hips, and particularly vices, are relatively heavy tools and are not usually considered portable on bicycles. Consequently, roadside replacement of sprockets usually is not considered practical with prior art devices. Furthermore, chain whips and freewheel vices are relatively expensive items carried only by bicycle service outlets, and thus it is not usual for a bicycle owner to contemplate removing and replacing sprockets from a freewheel himself.

SUMMARY OF THE INVENTION

The invention reduces the difficulties and disadvantages of the prior art as discussed above, by providing a simple, low cost and lightweight tool which can be purchased and used by the average bicycle owner. Because the invention is lightweight, it can be carried in the normal bicycle emergency repair kit, and if necessary can be used in an emergency roadside repair. While the device requires some skill in its use, it is relatively simple to use, and does not require additional costly or complex apparatus commonly found in a bicycle service outlet. The device uses portions of an existing bicycle to assist in removing the sprocket from the freewheel block as below.

The apparatus according to the invention is for unscrewing a bicycle chain sprocket from a bicycle sprocket cluster and includes a hook means and a sprocket engaging means. The hook means is for engaging a portion of a bicycle generally adjacent journalling means of the sprocket cluster. The hook means has first and second end portions and an intermediate portion, the intermediate portion being disposed between and rigidly interconnecting the end portions so that the end portions extend away from the intermediate portion in a generally similar direction. The first end portion is spaced sufficiently apart from the second end portion to receive a portion of the bicycle frame therebetween. The sprocket engaging means is for engaging a particular sprocket to be unscrewed and is connected to the hook means so as to prevent essentially rotation of the particular sprocket relative to the frame as torque is applied to the sprocket cluster. Preferably, the sprocket engaging means is a length of engagement chain for engaging teeth of the sprocket. The engagement chain has inner and outer ends and a length sufficient to pass essentially completely around the particular sprocket to be unscrewed, with the inner end of the chain being secured to the hook means.

A method according to the invention includes the steps of:

(a) providing a bicycle sprocket cluster mounted on a wheel journalled in a bicycle frame, in which at least the sprocket to be unscrewed is threaded onto a freewheel body;

(b) engaging the said sprocket to be unscrewed with a sprocket engaging means;

(c) securing the sprocket engaging means to the bicycle frame to prevent essentially movement of the sprocket engaging means relative to the frame, thus preventing movement of said sprocket;

(d) applying torque to the cluster of sprockets in a direction so as to unscrew the said sprocket.

Preferably, torque is applied to the freewheel cluster by using an existing drive chain of the bicycle, in which the chain extends between a large sprocket of the cluster, and a small chain ring driven by the pedals.

A detailed disclosure following, related to drawings, describes a preferred apparatus and method of invention, which is capable of expression in apparatus and method other than those particularly described and illustrated.

DETAILED DISCLOSURE

Figure 1:
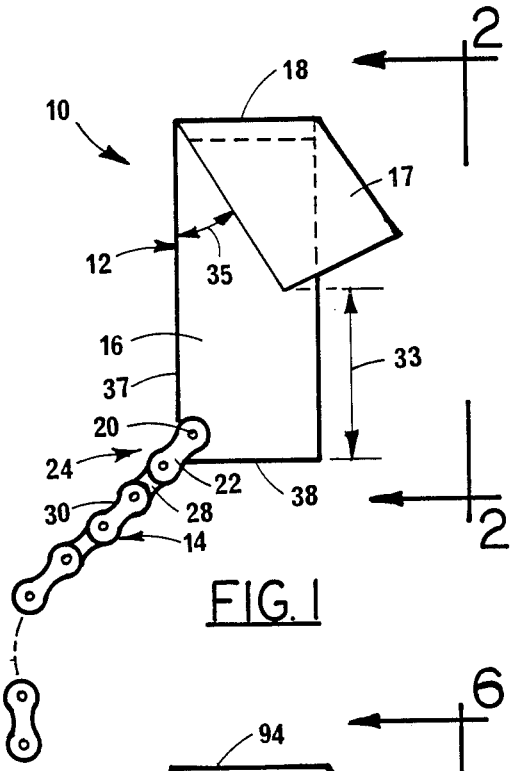
FIG. 1 is a simplified fragmented side elevation of a first embodiment of the apparatus according to the invention.
Figure 2:
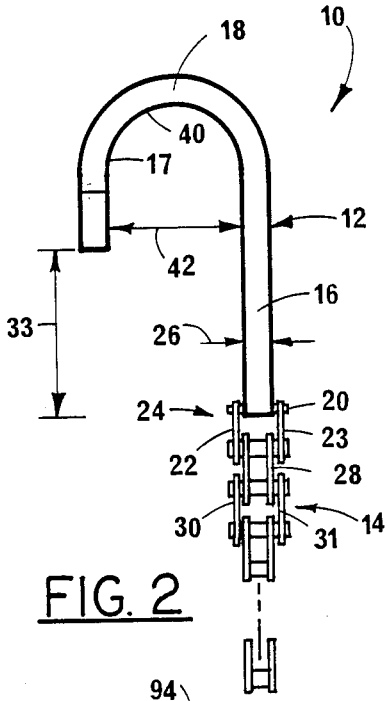
FIG. 2 is a simplifed end elevation as seen from line 2—2 of FIG. 1.

FIGS. 1 and 2

An apparatus 10 according to the invention includes a hook means 12 and a length of engagement chain 14 which is a short length of conventional bicycle chain. The hook means has first and second end portions 16 and 17 respectively, and an intermediate portion 18 disposed between the end portions. The first end portion 16 is connected to the length of chain 14 by a rivet 20 which passes through undesignated, aligned openings at outer ends of spaced side bars 22 and 23 of an innermost link 24 of the length of engagement chain 14. The hook means 12 is formed from a metal strip having a thickness 26 which is approximately equal to thickness of an adjacent narrower link 28 of the chain. The side bars 22 and 23 are conventional side bars of the chain, and are essentially identical to similar side bars 30 and 31 which extend on opposite sides of the link 28.

When the hook means is viewed longitudinally as in FIG. 2, the intermediate portion is generally U-shaped in cross section, and it can be seen that the first end portion is longer than the second end portion by a length 33. Furthermore, when the hook means is viewed transversely as seen in FIG. 1, the first and second end portions extend from the intermediate portion 18 so as to be inclined at an angle 35 to each other. The rivet 20 is located closely adjacent an intersection of an aft edge 37 and a lower edge 38 of the first end portion 16.

As best seen in FIG. 2, the intermediate portion 18 is curved downwardly and has a concave inner face 40 which is generally semi-circular, so that the first and second end portions extend in generally similar directions away from the intermediate portion. The first and second end portions are spaced apart by a spacing 42 which is sufficiently wide to receive a portion of a chainstay of a bicycle frame therebetween, as will be described with reference to FIGS. 3 and 4.

OPERATION

Figure 3:
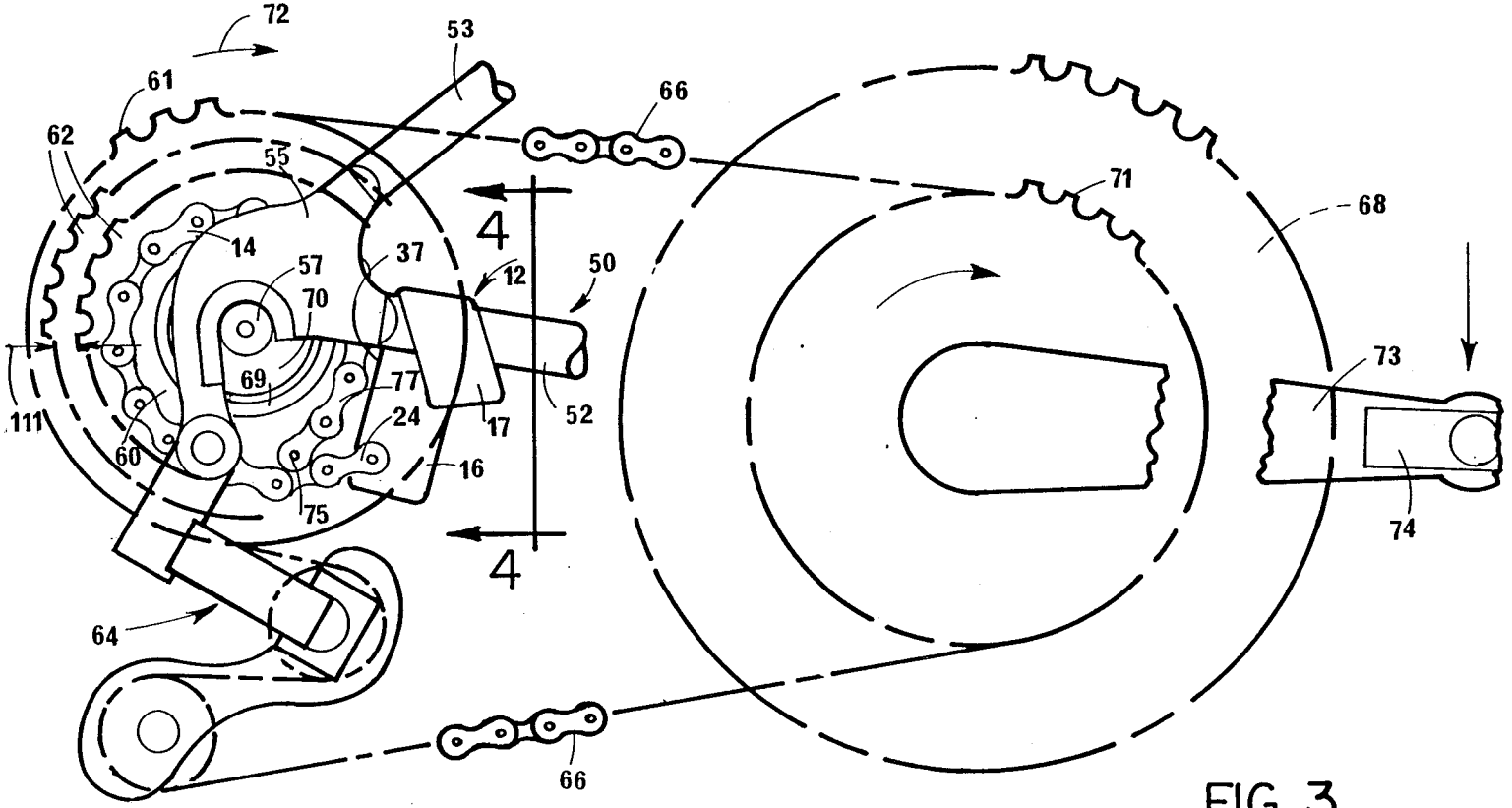
FIG. 3 is a simplified fragmented side elevation of a rear portion of a bicycle, shown fitted with the apparatus of the invention for removing a sprocket from a sprocket cluster.
Figure 4:
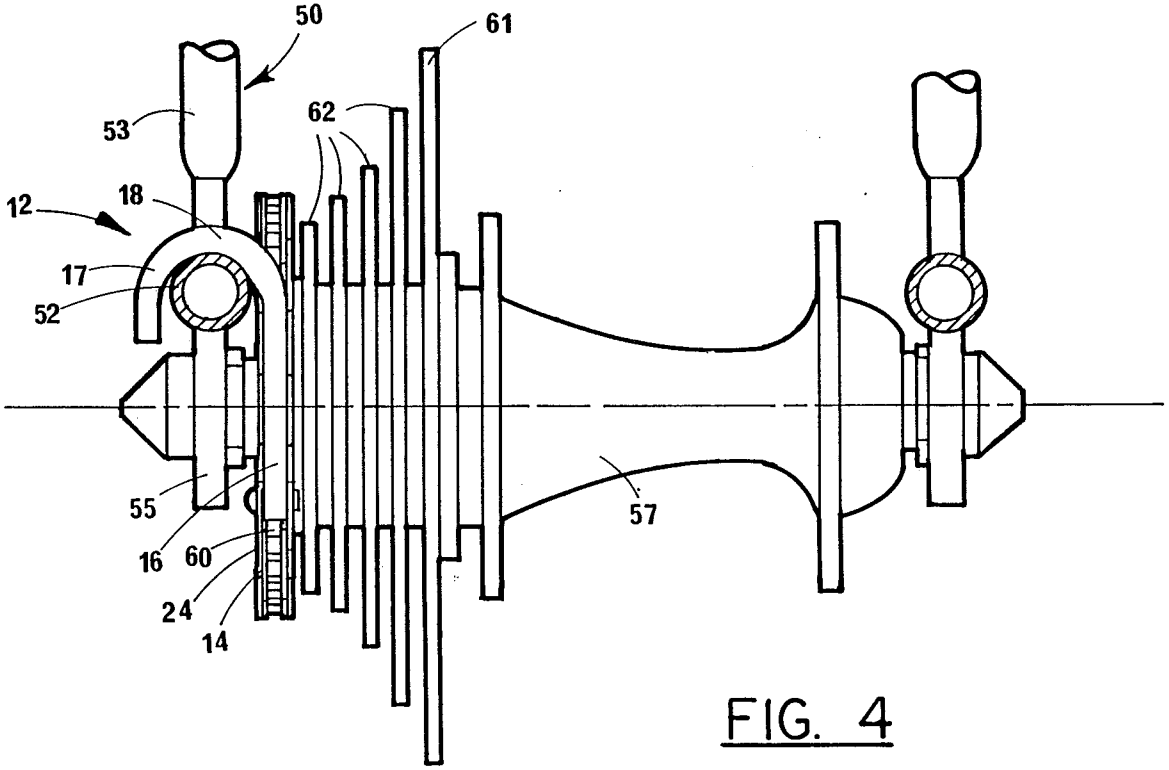
FIG. 4 is a simplified fragmented section of a portion of the bicycle and apparatus as would be seen from line 4—4 of FIG. 3.

FIGS. 3 and 4

As seen in FIG. 3, a bicycle frame 50, shown partially, has a right hand chainstay 52 and a right hand seatstay 53 interconnected at rear ends by a right hand rear fork end 55. A rear wheel hub 57 of a rear wheel, not shown, carries a bicycle sprocket cluster 59 having an outermost sprocket 60, the smallest, an innermost sprocket 61, the largest, and a plurality of intermediate sprockets 62 spaced between the sprockets 60 and 61. A derailleur gear changing mechanism 64 is connected to the fork end 55 and a conventional drive chain 66 of the bicycle passes around the innermost sprocket 61, the derailleur changing mechanism 64, and a chain wheel assembly 68. If the chain wheel assembly has dual or triple chain wheels, for sprocket unscrewing purposes preferably the drive chain should pass around the smallest chain wheel 71 as shown. A right hand pedal crank 73 extends from the chain wheel assembly and is shown at approximately 3 o'clock position as force is applied to a pedal 74, as will be described.

The above description describes a conventional multi-speed sport bicycle, usually having 10, 12, 15 or 18 variable gears. The outermost sprocket 60, which is to be unscrewed by the invention, is threaded onto an outer portion 69 of the freewheel body with a conventional right hand thread. The outer portion is journalled on an inner portion 70 of the freewheel body with a rachet drive means, not shown, to transmit drive only forwardly as is common practice. The remaining sprockets 61 and 62 are non-rotatably secured to the outer portion of the freewheel body, using splines, or on the older freewheels, some of the smaller sprockets are also threaded onto the outer portion of the freewheel body in a manner similar to the outermost sprocket.

The hook means 12 of the invention is fitted to engage the chain stay 52 so that the longer first end portion 16 is disposed between the chain stay and the wheel hub 57, and the second end portion 17 is disposed outwardly of the chainstay. The intermediate portion 18 rests on top of the chainstay 52 as shown, with the end portion 16 inclined rearwardly. The length of engagement chain 14 is wrapped in a clockwise direction around the outermost sprocket 60, the chain having a length such that an outer link 75 extends inwardly past the innermost link 24 so that the sprocket is completely wrapped by the chain 14.

It can be seen that the length of engagement chain 14 engages teeth of the sprocket, and has inner and outer ends, namely the inner and outer links 24 and 75, and a length sufficient to pass essentially completely around the particular sprocket to be unscrewed. In order to obtain maximum mechanical advantage when unscrewing, the right hand crank 73 is rotated until it assumes the 3 o'clock position as shown. At this time the length of chain 14 should be snugly wrapped around the sprocket 60, and the aft edge 37 of the first end portion 16 should be urged against links 77 of the chain 14 adjacent to the outer link 75. As best seen in FIG. 4, the concave inner face 40 of the hook means has a radius greater than the radius of the chain stay 52, and this permits limited lateral movement of the first end portion 16 so that the edge 37 thereof can become essentially aligned with the links 77 adjacent to the outer link 75. Because the thickness 26 of the first end portion 16 is essentially equal to width of the link assemblies 28 of the chain, i.e. the narrower portion of the engagement chain, the aft face can rest squarely on the chain, thus reducing twisting forces between the innermost link 24 and the end portion 16. This is important, because malignment between the chain 14 and the end portion 16 increases stresses on the innermost link 24, which can break the link itself, or cause the link to separate from the rivet 20.

To unscrew the sprocket 60, the operator places his right foot on the right pedal 74, and presses down hard so as to apply a clockwise torque to the chain wheel, which usually causes slight forward movement of the bicycle as the sprocket 60 tightens up the length of chain 14 through the drive chain 66. If sufficient force is applied to the crank 73, the sprocket 60 suddenly unscrews from the outer portion of the freewheel body until the pedal reaches the bottom of its stroke, i.e. adjacent the 6 o'clock position. The engagement chain 14 can then be unwrapped from the sprocket 60, and the sprocket 60 usually can be unscrewed by hand in an anti-clockwise direction, while preventing the freewheel block from rotating by holding the pedal.

If the outermost sprocket is the only sprocket that is threaded onto the outer portion of the freewheel body, the bicycle wheel is then removed from the frame. The remaining sprockets, being spined, can then be pulled axially from the freewheel body, permitting replacement as required.

Alternatively, if the freewheel sprocket has other sprockets as well as the outermost sprocket threaded onto the outer portion, the other sprockets would have to be removed with a similar apparatus, modified so as to engage the other sprockets to be unscrewed, in addition to the outermost sprocket. As stated above, it is important that the end portion 16 be aligned with the links 77 adjacent to the outer link 75 when force is applied. It is therefore important that the hook means can position itself on the chainstay 52 in a position so that the chain 14 can be aligned with the sprocket to be unscrewed. With most frame designs and sprocket clusters, the apparatus 10 can only be used to remove the first or outermost sprocket 60. When the sprocket 60 has been removed, if the length of the chain 14 is then wrapped around a second sprocket, adjacent to the outermost sprocket, when force is applied to the length of the chain, the hook means 12 has a tendency to swing about the chainstay. This swinging causes the first end portion 16 to become inclined at an angle to the outer portion of the chain 14, when viewed rearwardly, as would be seen in FIG. 4. In this position, because the hook means would then be out of alignment with the chain, if an extracting force is then applied to the pedals, failure of the link 24 or rivet 20 is likely to occur. Thus, to remove a sprocket other than the outermost sprocket, a modified or alternative extracting apparatus is usually required, as described with reference to FIGS. 5 and 6.

ALTERNATIVES

Figure 5:
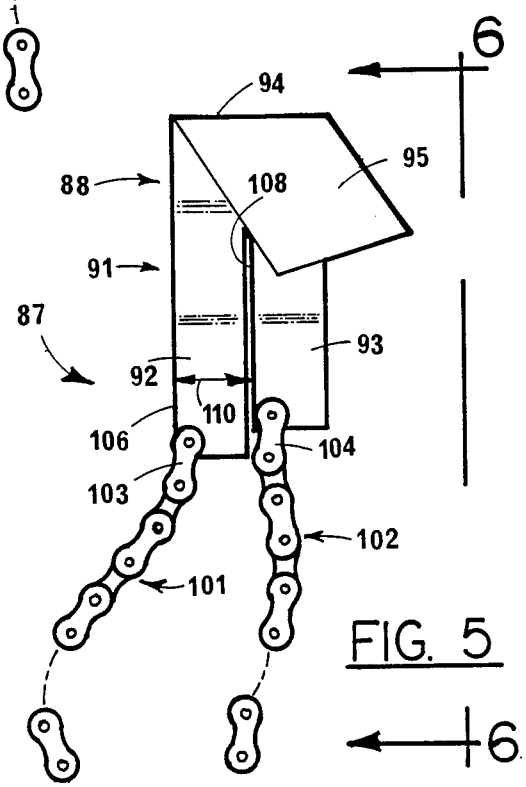
FIG. 5 is a simplified, fragmented side elevation of a second embodiment of the invention, shown fitted with two engagement chains for extracting a sprocket other than an outermost sprocket of the cluster.
Figure 6:
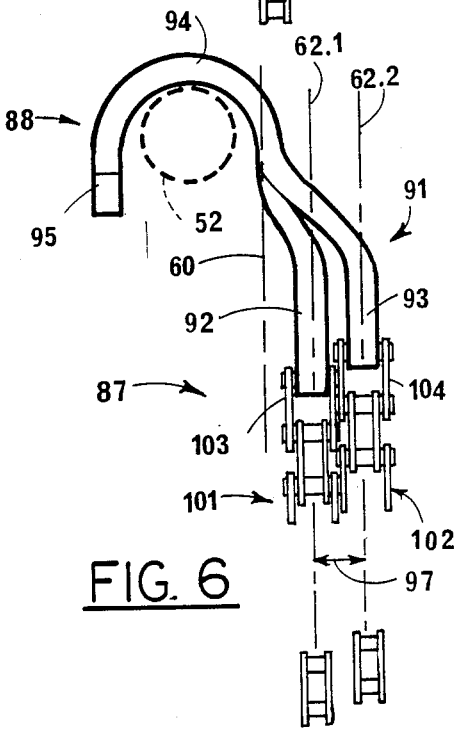
FIG. 6 is a simplified end elevation of the second embodiment, as seen from line 6—6 of FIG. 5, portions of a sprocket cluster and bicycle frame being shown diagrammatically.

FIGS. 5 and 6

For unscrewing sprockets of a sprocket cluster other than the outermost sprocket, an alternative apparatus 87 is used.

The apparatus 87 has a hook means 88 having a bifurcated first end portion 91 having outer and inner fingers 92 and 93. The hook means has a second end portion 95, which is shorter than the first end portion, and also has an intermediate portion 94 disposed between the end portions. Similarly to the hook means 12, the first and second portions extend from and are spaced apart by the intermediate portion to receive a portion of the bicycle frame therebetween. The inner finger is spaced inwardly of the outer finger by a distance 97 which is approximately equal to spacing between adjacent sprockets 62.1 and 62.2 of the sprocket cluster. The sprockets 62.1 and 62.2 are the second and third sprockets from the outermost sprocket 60, and in this particular design of freewheel block these are also threaded onto the outer portion of the block, and consequently would require unscrewing for removal. First and second lengths of engagement chain 101 and 102 have respective inner ends 103 and 104 connected to the outer finger 92 and the inner finger 93 respectively. The first and second lengths of engagement chain have sufficient respective lengths to pass essentially completely around the particular sprockets to be unscrewed, namely the sprockets 62.1 and 62.2. As before, a slight overlap of ends of the chain is preferable to insufficient length, and because there tends to be a wide variation in the number of teeth of intermediate sprockets, a length of chain longer than the circumference of a minimum size intermediate sprocket is preferred.

As best seen in FIG. 5, the outer finger 92 has a rear edge portion 106 which is positioned rearwardly of a similar rear edge portion 108 of the inner finger 93. The rear edge portions 106 and 108 are spaced apart a distance 110, as measured generally radially of the sprocket cluster. The distance 110 is of the order of magnitude of radial spacing between adjacent intermediate sprockets of a cluster, a typical radial spacing 110 between adjacent sprockets being shown in FIG. 3. Clearly, there can be a considerable variation in the radial spacing between a close ratio racing block cluster, and a wider ratio touring block cluster, but this is not critical.

As stated previously, it is important to ensure that the sprocket being unscrewed is generally aligned with the appropriate length of engagement chain and its associated finger portion, when extraction force is applied by the pedals. Thus, the spacing 110 and distance 97 may require some selection for sprocket clusters of particular types. In order to reduce twisting forces on the engagement chain, the inner end 104 of the second length of engagement chain 102 should be aligned with the sprocket 62.2, while the inner end 103 of the first length of engagement chain 101 is aligned with the sprocket 62.1.

In operation, the outermost sprocket, or smaller sprocket 60, is removed using the apparatus 10 of FIGS. 1 and 2, which apparatus is then removed, and the sprocket can be fully unscrewed. Assuming that the second and third sprockets 62.1 and 62.2 are also threaded on the block, the alternative apparatus 87 is then fitted on the chainstay 52 as seen in broken outline in FIG. 6. The first length of engagement chain 101 is wrapped around the second sprocket 62.1 in a clockwise direction and the second sprocket can then be loosened as previously described, but not completely unscrewed, from the outer portion of the freewheel block. Without removing the first length of chain 101 from the sprocket 62.1, the second length of chain 102 is wrapped around the third sprocket 62.2, in a manner similar to the first length of chain. Assuming that the distance 97 and the spacing 110 are compatible with the sprocket cluster, the first and second lengths of engagement chain should both completely enclose their respective sprockets 62.1 and 62.2 respectively. Thus, when torque is applied to the sprocket cluster by the existing drive chain, and the extraction force is applied to the third sprocket 62.2, the outer finger 92 is simultaneously forced against the first length of chain while the inner finger 93 is forced against the second length of chain. The lengths of chain engage the respective sprocket and thus assist in resisting a twisting force generated on the hook means by the second length of chain. Consequently, while unscrewing the third sprocket 62.2, the partially unscrewed second sprocket assists in maintaining alignment between the second length of chain, the inner finger, and third sprocket 62.2. When the third sprocket 62.2 is loosened, the second sprocket 62.1 can be completely unscrewed from the block, usually by hand, which then permits complete unscrewing and removal of the third sprocket 62.2. Alternatively, if the fourth sprocket was also to be unscrewed, the third sprocket 62.2 would remain, partially unscrewed, on the freewheel block to similarly assist in loosening of the fourth sprocket. However, many modern sprocket clusters have intermediate sprockets splined onto the outer portion of the freewheel block, and thus do not require unscrewing.

In summary, it can be seen that the hook means 12 and 89 engage a portion of a bicycle generally adjacent journally means, i.e. the wheel axle or hub, of the sprocket cluster. It can also be seen that the engagement chain serves as a sprocket engaging means for engaging a particular sprocket to be unscrewed. The sprocket engaging means is effectively connected to the hook means so as to prevent, essentially, rotation of the particular sprocket relative to the frame as torque is applied to the sprocket cluster. If the sprocket cluster includes other sprockets as well as the outermost sprocket that are threaded, a second sprocket engaging means is required for engaging a sprocket of the cluster disposed inwardly of the outermost sprocket. Similarly to the first sprocket engaging means, the second sprocket engaging means is connected to the hook means.

In summary, it can be seen that the method of the invention relates to unscrewing a bicycle chain sprocket from a bicycle sprocket cluster and includes the following steps. The bicycle sprocket cluster is mounted on a wheel journalled in a bicycle frame, in which at least the sprocket to be unscrewed is threaded onto a freewheel body. The said sprocket to be unscrewed is engaged with a sprocket engaging means. The sprocket engaging means is secured to the bicycle frame to prevent essentially movement of the sprocket engaging means relative to the frame, thus preventing movement of the said sprocket. Torque is applied to the cluster of sprockets in a direction so as to unscrew the said sprocket. Preferably, torque is applied to the freewheel cluster by using an existing drive chain of the bicycle. The drive chain is loaded by applying a load to a pedal of the bicycle, preferably when the pedal is generally adjacent to the 3 o'clock position relative to the chain ring. For increased torque, the existing drive chain of the bicycle extends between a large sprocket of the cluster and a small chain ring driven by the pedals.

I claim:

1. An apparatus for unscrewing a bicycle chain sprocket from a bicycle sprocket cluster, the apparatus having:

(a) a hook means for engaging a portion of a bicycle frame generally adjacent journalling means of the sprocket cluster, the hook means having first and second end portions and an intermediate portion, the intermediate portion being disposed between and rigidly interconnecting the end portions so that the end portions extend away from the intermediate portion in a generally similar direction, the first end portion lying in a plane offset from the second end portion to receive a portion of the bicycle frame therebetween, (b) a sprocket engaging means for engaging a particular sprocket to be unscrewed, the sprocket engaging means being connected to the first end portion of the hook means so as to prevent essentially rotation of the particular sprocket relative to the frame as torque is applied to the sprocket cluster.

2. An apparatus as claimed in claim 1 in which:

(a) the sprocket engaging means is a length of engagement chain for engaging teeth of the sprocket, the engagement chain having inner and outer ends and a length sufficient to pass essentially completely around the particular sprocket to be unscrewed, with the inner end of the chain being secured to the hook means.

3. An apparatus as claimed in claim 1 in which:

(a) the hook means has first and second end portions and an intermediate portion disposed between the end portions, the first end portion being connected to the sprocket engagement means and being spaced apart from the second end portion to receive the portion of the bicycle frame therebetween.

4. An apparatus as claimed in claim 3 in which:

(a) the first and second end portions extend in a generally similar direction away from the intermediate portion, and are spaced apart by the intermediate portion sufficiently to receive a chain stay of the bicycle frame therebetween.

5. An apparatus as claimed in claim 1 in which:

(a) the intermediate portion is generally U-shaped in cross-section when viewed longitudinally, and the first and second end portions extend from the intermediate portion so as to be inclined at an angle to each other when viewed transversely.

6. An apparatus as claimed in claim 1 in which:

(a) the sprocket engaging means is a first means for engaging an outer sprocket of the sprocket cluster, and the apparatus further includes:

(b) a second sprocket engaging means for engaging a sprocket of the cluster disposed inwardly of the outer sprocket, the second sprocket engaging means being connected to the hook means.

7. An apparatus as claimed in claim 6 in which:

(b) the second sprocket engaging means is connected to the hook means at a location disposed inwardly of the connection of the first sprocket engaging means and the hook means.

8. An apparatus as claimed in claim 1 in which:

(a) the hook means has a bifurcated first end portion, having outer and inner fingers, the inner finger being spaced inwardly of the outer finger a distance approximately equal to spacing between a pair of adjacent sprockets of the sprocket cluster, (b) the sprocket engaging means includes first and second lengths of engagement chain, the first length having a respective inner end secured to the outer finger, and the second length having a respective inner end secured to the inner finger, the lengths of engagement chain being sufficient to pass essentially completely around the respective sprocket to be unscrewed.

9. A method of unscrewing a bicycle chain sprocket from a bicycle sprocket cluster, the method including the steps of:

(a) providing a bicycle sprocket cluster mounted on a wheel journalled in a bicycle frame, in which at least the sprocket to be unscrewed is threaded onto a freewheel body, (b) engaging the said sprocket to be unscrewed with a sprocket engaging means, (c) securing the sprocket engaging means to the bicycle frame to prevent essentially movement of the sprocket engaging means relative to the frame, thus preventing movement of the said sprocket, (d) applying torque to the cluster of sprockets in a direction so as to unscrew the said sprocket.

10. A method as claimed in claim 9 further characterized by:

(a) applying torque to the freewheel cluster by using an existing drive chain of the bicycle.

11. A method as claimed in claim 10 further characterized by:

(a) applying torque to the freewheel cluster by applying a load to pedals of the bicycle, the existing chain of the bicycle extending between a large sprocket of the cluster, and a small chain ring driven by the pedals.

12. A method as claimed in claim 9 further characterized by:

(a) providing in the bicycle sprocket cluster a second sprocket to be unscrewed, the second sprocket being threaded onto the freewheel body at a position disposed inwardly of the first sprocket, (b) after loosening the first sprocket, engaging the second sprocket with a second sprocket engaging means which is similarly secured to the bicycle frame, thus preventing movement of the second sprocket, (c) applying torque to the sprocket cluster in a direction so as to unscrew the second sprocket.

13. In combination with a bicycle, as apparatus for unscrewing a bicycle chain sprocket from a bicycle sprocket cluster, the bicycle having a bicycle frame and a wheel, the wheel and cluster being journalled within the frame, the apparatus including:

(a) a hook means engaging a portion of the bicycle frame generally adjacent journalling means of the sprocket cluster, the hook means having first and second end portions and an intermediate portion, the intermediate portion being disposed between and rigidly interconnecting the end portions so that the end portions extend away from the intermediate portion in a generally similar direction, the first end portion lying in a plane offset from the second end portion to receive a portion of the bicycle frame therebetween;

(b) a sprocket engaging means engaging a particular sprocket to be unscrewed, the sprocket engaging means being connected to the first end portion of the hook means so as to prevent essentially rotation of the particular sprocket relative to the frame as torque is applied to the sprocket cluster.

14. An apparatus as claimed in claim 13 in which:

(a) the sprocket engaging means is a length of engagement chain engaging teeth of the particular sprocket, the engagement chain having inner and outer ends and a length sufficient to pass essentially completely around the particular sprocket to be unscrewed to that the outer end of the chain is generally adjacent the hook means when the inner end of the chain is secured to the hook means.

15. An apparatus for unscrewing at least two bicycle chain sprockets from a bicycle sprocket cluster, the apparatus having:

(a) a hook means for engaging a portion of a bicycle frame generally adjacent journalling means of the sprocket cluster, (b) first and second sprocket engaging means for engaging first and second sprockets, the first sprocket being an outer sprocket of the sprocket cluster, and the second sprocket being a sprocket of the cluster disposed inwardly of the outer sprocket, the first and second sprocket engaging means being connected to the hook means so as to prevent essentially rotation relative to the frame of a particular sprocket engaged by an engaging means as torque is applied to the sprocket cluster.

16. An apparatus as claimed in claim 15 in which:

(a) the second sprocket engaging means is connected to the hook means at a location disposed inwardly of the connection of the first sprocket engaging means and the hook means.

17. An apparatus for unscrewing a bicycle chain sprocket from a bicycle sprocket cluster, the apparatus having:

(a) a hook means for engaging a portion of a bicycle frame generally adjacent journalling means of the sprocket cluster, the hook means having a bifurcated first end portion having outer and inner fingers, the inner finger being spaced inwardly of the outer finger a distance approximately equal to spacing between a pair of adjacent sprockets of the sprocket cluster, (b) a sprocket engaging means for engaging a particular sprocket to be unscrewed, the sprocket engaging means including first and second lengths of engagement chain, the first length of chain having a respective inner end secured to the outer finger, and the second length of chain having a respective inner end secured to the inner finger, the lengths of engagement chain being sufficient to pass essentially completely around a respective sprocket to be unscrewed, so that when the hook means engages the bicycle frame and torque is applied to the sprocket cluster, the hook means and sprocket engaging means prevent essentially rotation of a particular sprocket to be unscrewed.

18. An apparatus as claimed in claim 15 in which:

(a) the intermediate portion is generally U-shaped in cross-section when viewed longitudiinally, and the first and second end portions extend from the intermediate portion so as to be inclined at an angle to each other when viewed transversely.

19. An apparatus as claimed in claim 17 in which:

(a) the intermediate portion is generally U-shaped in cross-section when viewed longitudinally, and the first and second end portions extend from the intermediate portions so as to be inclined at an angle to each other when viewed transversely.

20. An apparatus as claimed in claim 13 in which:

(a) the intermediate portion is generally U-shaped in cross-section when viewed longitudinally, and the first and second end portions extend from the intermediate portions so as to be inclined at an angle to each other when viewed transversely.

* * * * *